US007228845B2

(12) United States Patent
Yamamoto

(10) Patent No.: US 7,228,845 B2
(45) Date of Patent: Jun. 12, 2007

(54) FUEL INJECTION APPARATUS FOR INTERNAL COMBUSTION ENGINE

(75) Inventor: Yoshihisa Yamamoto, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 74 days.

(21) Appl. No.: 11/282,698

(22) Filed: Nov. 21, 2005

(65) Prior Publication Data

US 2006/0107927 A1 May 25, 2006

(30) Foreign Application Priority Data

Nov. 22, 2004 (JP) ..... 2004-337817

(51) Int. Cl.
*F02M 37/04* (2006.01)

(52) U.S. Cl. ..... 123/446; 123/447; 123/467

(58) Field of Classification Search ..... 123/446, 123/447, 467, 496, 510, 511
See application file for complete search history.

(56) References Cited

U.S. PATENT DOCUMENTS 5,622,152 A 4/1997 Ishida
6,453,875 B1 * 9/2002 Mahr et al. ..... 123/446
7,007,671 B2 * 3/2006 Nakayama et al. ..... 123/446
7,040,288 B2 * 5/2006 Nakayama et al. ..... 123/446
7,107,966 B2 * 9/2006 Tanabe et al. ..... 123/446
7,128,058 B2 * 10/2006 Yamamoto ..... 123/495
2006/0042597 A1 * 3/2006 Magel ..... 123/446

FOREIGN PATENT DOCUMENTS

JP 2003-106235 4/2003

OTHER PUBLICATIONS

U.S. Appl. No. 11/224,098, filed Sep. 13, 2005—English Counterpart of JP 2004-279494.

* cited by examiner

*Primary Examiner*—Thomas Moulis
(74) *Attorney, Agent, or Firm*—Nixon & Vanderhye P.C.

(57) ABSTRACT

A fuel injection apparatus has an accumulator, a booster, a nozzle, a hydraulic circuit, a hydraulic pressure valve and a control valve. At least one of a transmission path, which is connected to the hydraulic circuit, and the hydraulic piston is configured to generate a delay in an operation of the nozzle or the booster that is driven by one of fuel pressure in the control chamber and fuel pressure in the back pressure chamber that is directly controlled by the control valve, against an operation of the booster or the nozzle that is driven by the other of the fuel pressure in the back pressure chamber and the fuel pressure in the control pressure indirectly controlled by the hydraulic pressure valve.

14 Claims, 11 Drawing Sheets

FUEL INJECTION APPARATUS FOR INTERNAL COMBUSTION ENGINE

CROSS REFERENCE TO RELATED APPLICATION

This application is based upon and claims the benefit of priority of Japanese Patent Application No. 2004-337817 filed on Nov. 22, 2004, the content of which is incorporated herein by reference.

FIELD OF THE INVENTION

The present invention relates to a fuel injection apparatus for an internal combustion engine, specifically for a diesel engine.

BACKGROUND OF THE INVENTION

Conventionally a common rail system is known as a fuel injection apparatus for an internal combustion engine. The common rail system is provided with an accumulator (a common rail) that accumulates fuel therein at a specific pressure, and injects high pressure fuel supplied from the accumulator via an injector into a cylinder of the internal combustion engine. The common rail system has an excellent performance that can independently control an injection pressure and an injection amount from each other. It is demanded recently to improve the performance of the common rail system further to make exhaust gas clean and to improve a fuel consumption performance. U.S. Pat. No. 5,622,152 and its counterpart JP-2885076-B2 disclose a fuel injection apparatus to satisfy this demand in a simple fashion The fuel injection apparatus disclosed in U.S. Pat. No. 5,622,152 is provided with; a hydraulic control mechanism for opening and closing the nozzle, which is an advantage of the common rail system; and a pressure increasing mechanism to increase a fuel pressure in the accumulator. The pressure increasing mechanism enables fuel injection at still higher pressure, and both of pressure increasing control and fuel injection control. As a result, the fuel injection apparatus can change fuel injection pressure during one injection cycle, to realize a micro injection at a low pressure and a main injection at a super high pressure, and to optimize a pattern of an injection ratio. Accordingly, further minute optimization of fuel combustion is achieved.

In the above-mentioned fuel injection apparatus disclosed in U.S. Pat. No. 5,622,152, however, it is substantially necessary to independently control two operations, that is, the pressure increasing operation and the fuel injection operation from each other. Thus, the fuel injection apparatus requires at least two actuators, for example, to make a construction of the system intricate, and to increase a manufacturing cost thereof.

In this regard, JP-2003-106235-A2 discloses another fuel injection apparatus that can achieve functions equivalent to those of the above-mentioned fuel injection system (disclosed in U.S. Pat. No. 5,622,152 and JP-2885076-B2).

FIG. 11 depicts a hydraulic circuit of the fuel injection apparatus disclosed in JP-2003-106235-A2. The fuel injection apparatus has a control valve 100 that is driven by one actuator. The control valve 100 is connected via a fuel passage 130 to a booster 110, via a fuel passage 140 to a nozzle 120, and via a fuel passage 150 to an accumulator 160. The control valve 100 is provided with: a hydraulic pressure port 101 that is connected to the fuel passages 130, 140; and a low pressure port 102 that is connected to a low pressure side drain passage 170. A valve body 103 is driven between: a valve closing position (the position shown in FIG. 11) to block a communication between the hydraulic pressure port 101 and the low pressure port 102; and a valve opening position to allow the communication between the hydraulic pressure port 101 and the low pressure port 102.

When the valve body 103 is driven to the valve closing position, fuel pressure in the accumulator 160 is transmitted to a control chamber 111 of the booster 110 and a back pressure chamber 121 of the nozzle 120. In the booster 110 in this time, the hydraulic pressure is in balance between an upstream and downstream sides of a hydraulic piston 112, which is installed in the booster 110. Thus, the pressure of the fuel, which is supplied from the accumulator 160 via a fuel passage 180 to the pressure increase chamber 113, does not increase. Concurrently, in the nozzle 120, a needle (not shown), which is installed therein and receives the fuel pressure in the back pressure chamber 121, keeps a valve closing state, not to perform fuel injection.

When the valve body 103 is driven to the valve opening position, the hydraulic pressure port 101 and the low pressure port 102 of the control valve 100 is communicated with each other, so that the fuel pressure in the control chamber 111 and in the back pressure chamber 121 is released via the control valve 100 to a lower pressure side. Thus, in the booster 110, the hydraulic pressure comes out of balance between the upstream and downstream sides of the hydraulic piston 112, to move the hydraulic piston 112 downward in the figure, so that the pressure of the fuel in the pressure increase chamber 113 increases, and the fuel is supplied to the nozzle 120. In the nozzle 120, a fuel pressure decrease in the back pressure chamber 121 lifts the needle upward, to inject the super high pressure fuel supplied from the booster 110.

In the above-mentioned fuel injection apparatus disclosed in JP-2003-106235-A2, the control chamber 111 of the booster 110 and the back pressure chamber 121 of the nozzle are connected to the accumulator 160 at all times. That is, the control chamber 111 and the back pressure chamber 121 are respectively in communication with the accumulator 160 at all times regardless of a valve opening and closing state of the control valve 100. Accordingly, the fuel passages 130, 140 and 150 are respectively provided with apertures 190, 200 and 210. However, it is difficult to optimize controls of the booster 110 and the nozzle 120 because of an interaction among the apertures 190, 200 and 210.

SUMMARY OF THE INVENTION

The present invention is achieved in view of the above-described issues, and has an object to provide a fuel injection apparatus for an internal combustion engine that is able to control a pressure increase operation by a booster and an injection operation by a nozzle with high accuracy, and to secure enough control flexibility with one actuator.

The fuel injection apparatus has an accumulator, a booster, a nozzle, a hydraulic circuit, a hydraulic pressure valve and a control valve. The accumulator accumulates fuel therein at a predetermined pressure. The booster is provided with a control chamber in which fuel pressure changes in accordance with a fuel inflow into the control chamber and a fuel outflow out of the control chamber. The booster is further provided with a hydraulic piston that moves in accordance with a change of the fuel pressure in the control chamber. The booster pressurizing the fuel supplied from the accumulator in accordance with a pressurizing operation of the hydraulic piston. The nozzle is provided with a back pressure chamber in which fuel pressure changes in accordance with a fuel inflow into the back pressure chamber and a fuel outflow out of the back pressure chamber. The nozzle is further provided with a needle that moves in accordance with a change of the fuel pressure in the back pressure chamber. The nozzle injects the fuel supplied from the accumulator or the fuel pressurized by the booster in accordance with a valve opening operation of the needle. The hydraulic circuit is provided with a fuel passage for transmitting the fuel pressure in the accumulator to the back pressure chamber, and a fuel passage for releasing the fuel pressure in the back pressure chamber to a low pressure system. The hydraulic pressure valve is provided with a valve body that is disposed in the fuel passage communicated with the control chamber or disposed in a fuel passage communicated with the back pressure chamber to open and block the fuel passage to control an operation of the valve body in accordance with the fuel pressure that is transmitted via a transmission path connected to the hydraulic circuit. The control valve is provided with a valve body that is driven by a two-position actuator. The valve body connects any one of a high pressure side communicated the accumulator and the low pressure system communicated with a fuel tank to the hydraulic circuit, to control the hydraulic circuit, and to control the fuel pressure transmitted to the hydraulic pressure valve. One of the fuel pressure in the control chamber and the fuel pressure in the back pressure chamber is directly controlled by the control valve. The other of the fuel pressure in the control chamber and the fuel pressure in the back pressure chamber is indirectly controlled via the hydraulic pressure valve, to control an operation of the booster and an operation of the nozzle.

At least one of the transmission path and the hydraulic piston is configured to generate a delay in an operation of the nozzle or the booster that is driven by the one of the fuel pressure in the control chamber and the fuel pressure in the back pressure chamber directly controlled by the control valve, against an operation of the booster or the nozzle that is driven by the other of the fuel pressure in the back pressure chamber and the fuel pressure in the control pressure indirectly controlled by the hydraulic pressure valve.

BRIEF DESCRIPTION OF THE DRAWINGS

Other objects, features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

First Embodiment

Figure 1:
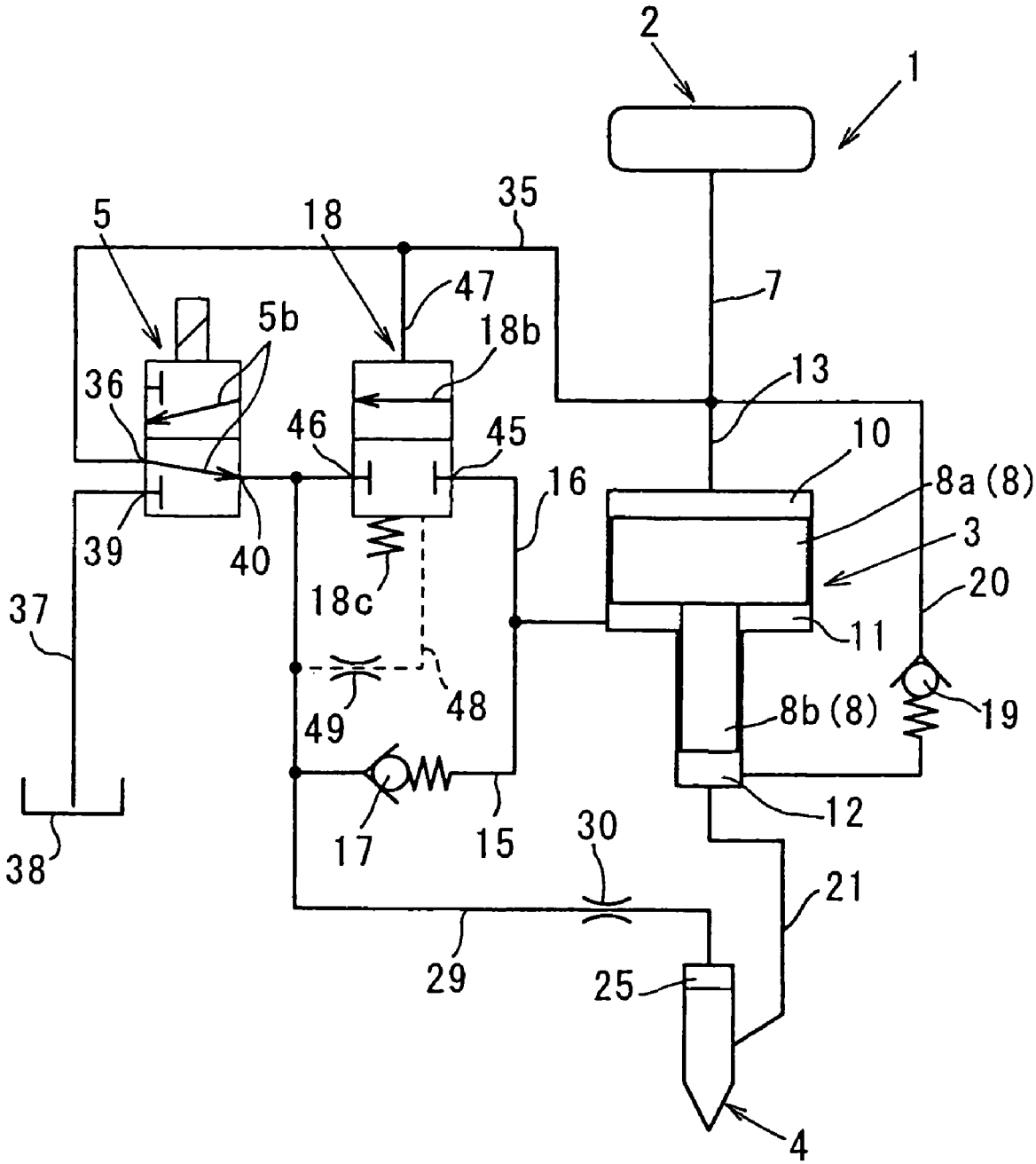
FIG. 1 is a hydraulic circuit diagram of a fuel injection apparatus according to a first embodiment of the present invention.
Figure 2:
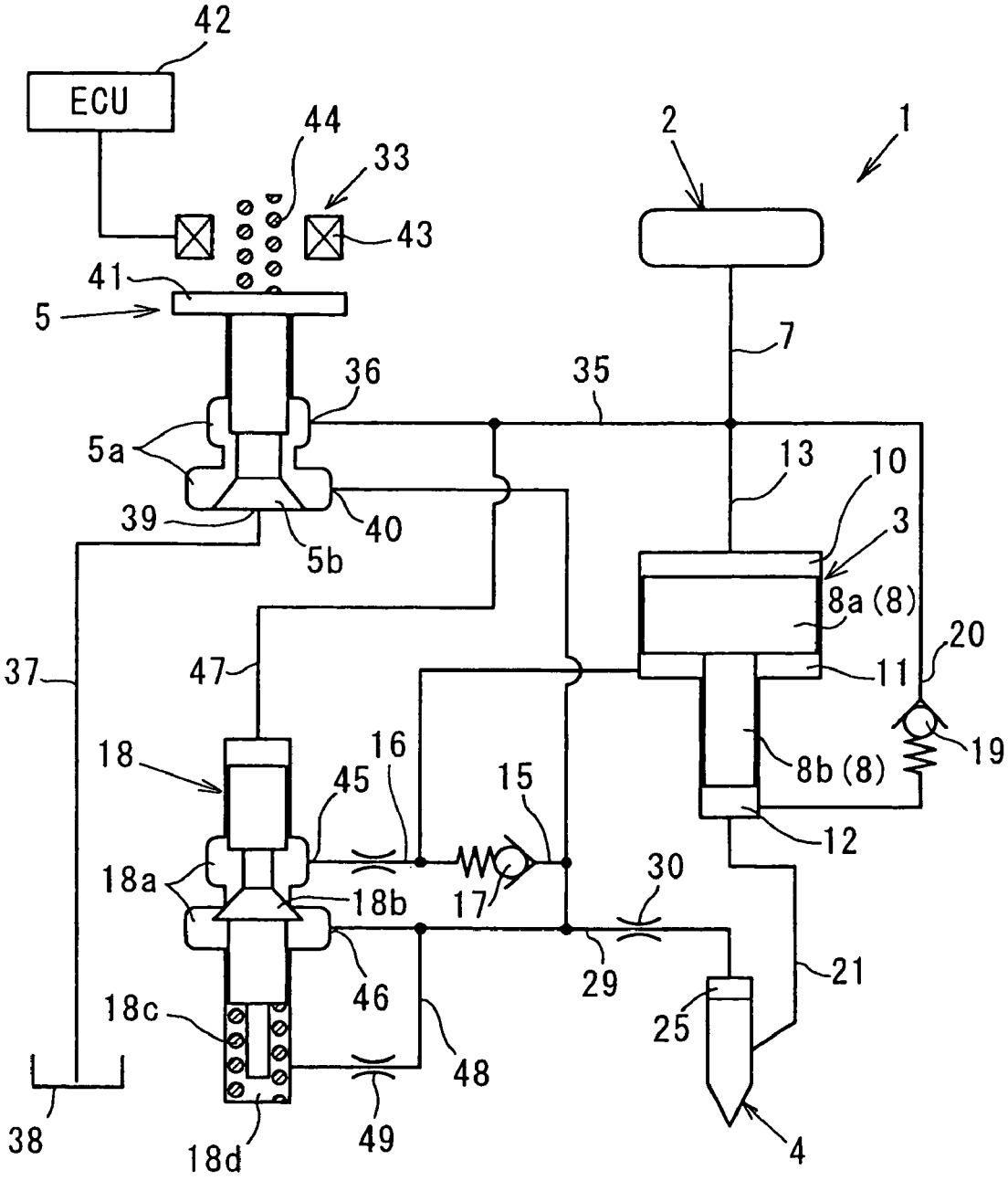
FIG. 2 is a detailed hydraulic circuit diagram system of the fuel injection apparatus according to the first embodiment, which includes a specific construction of a control valve and a hydraulic pressure valve.
Figure 3:
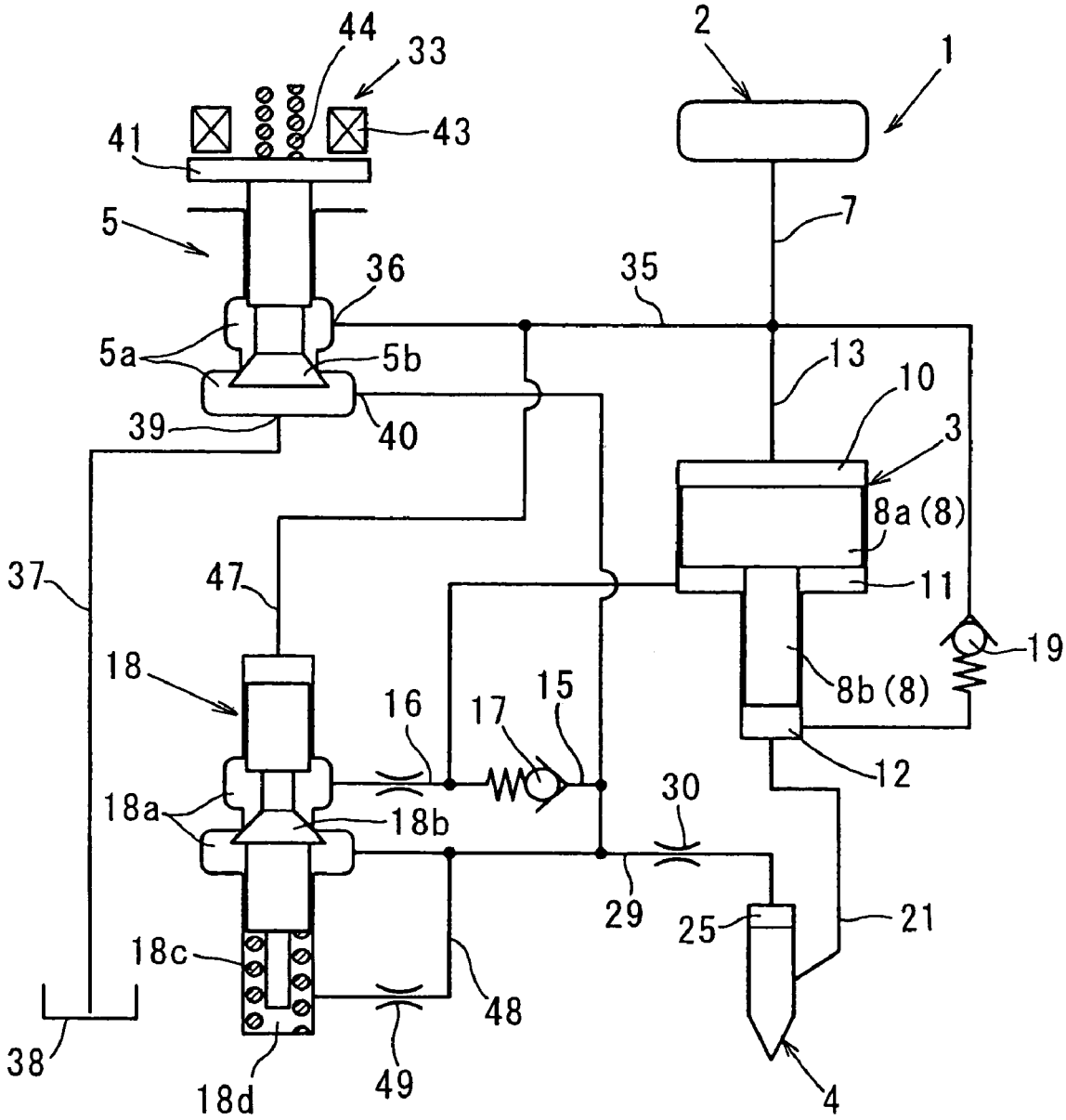
FIG. 3 is another hydraulic circuit diagram of a fuel injection apparatus according to a first embodiment of the present invention.
Figure 4:
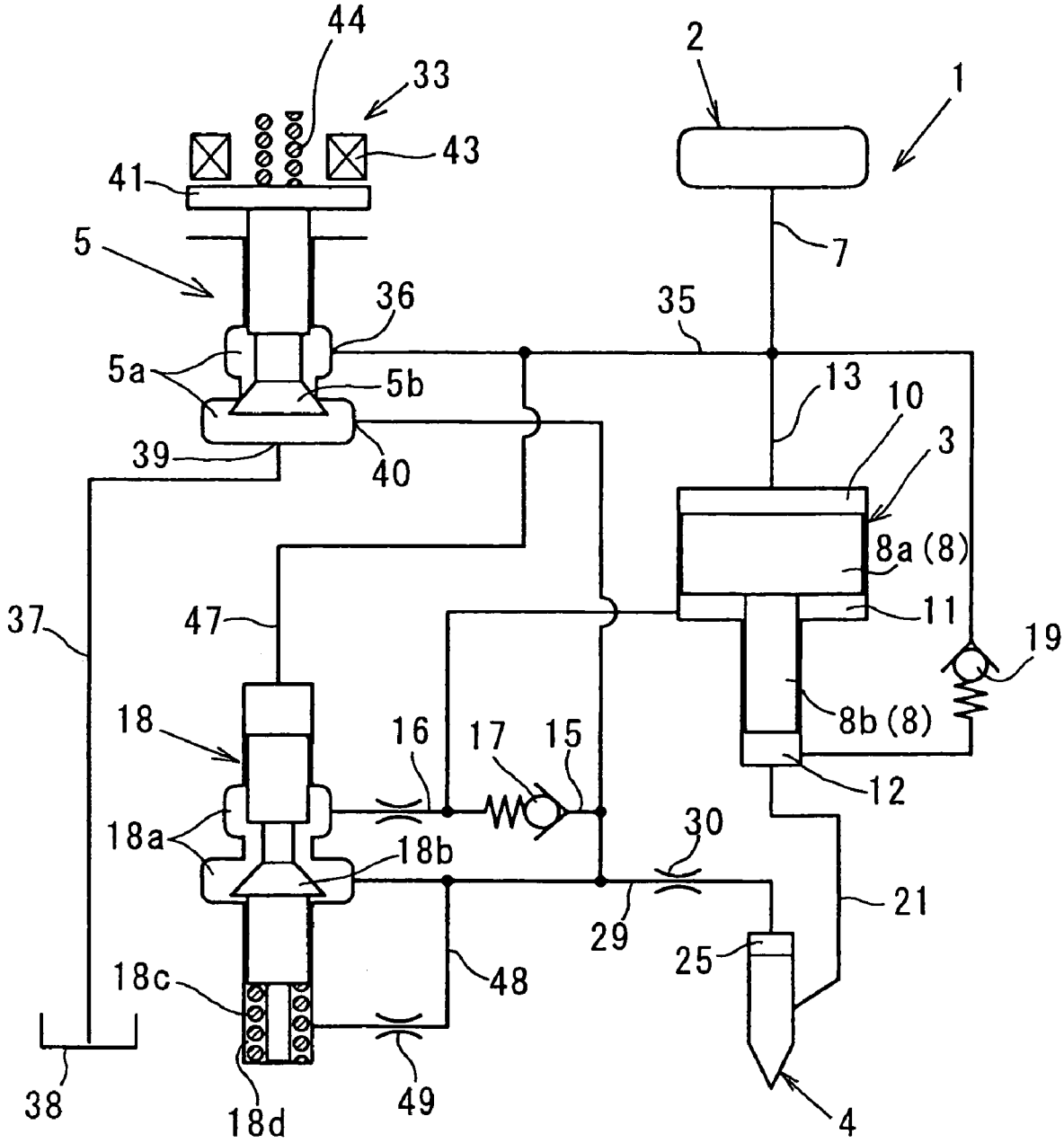
FIG. 4 is still another hydraulic circuit diagram of a fuel injection apparatus according to a first embodiment of the present invention.

FIG. 1 depicts a hydraulic circuit of a fuel injection apparatus according to a first embodiment of the present invention. FIGS. 2-4 respectively depict the hydraulic circuit in detail and show specific constructions of a control valve and a hydraulic pressure valve in the fuel injection apparatus.

Figure 5:
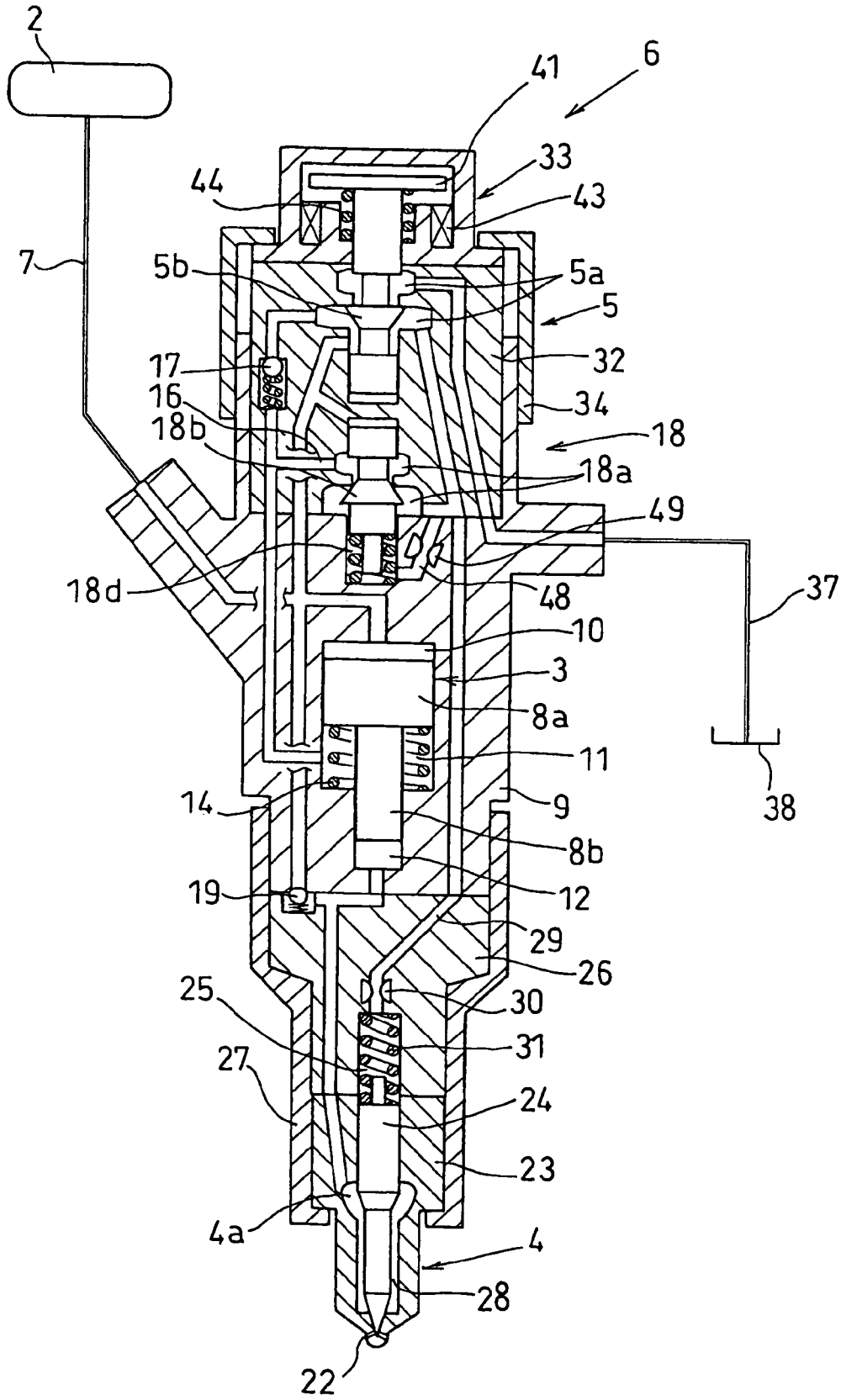
FIG. 5 is a schematic cross-sectional view showing an entire construction of a fuel injection valve in the fuel injection apparatus according to the first embodiment.

The fuel injection apparatus 1 according to the first embodiment is applied to a common rail system of a diesel engine for a vehicle, for example. As shown in FIG. 1, the fuel injection apparatus 1 is provided with: an accumulator 2 for accumulating fuel therein at a specific pressure; a booster 3 for increasing the pressure of the fuel that is supplied from the accumulator 2; a nozzle 4 for injecting the fuel that is supplied from the accumulator 2 or the fuel whose pressure is increased by the booster 3; a control valve 5 for controlling an operation of the booster 3 and an operation of the nozzle 4; and so on. The components except the accumulator 2, that is, the booster 3, the nozzle 4, the control valve 5, etc. constitutes a fuel injection valve 6 as shown in FIG. 5.

The accumulator 2 is connected by a fuel pipe 7 to the fuel injection valve 6 to supply the fuel, which is accumulated in the accumulator 2, via the fuel pipe 7 to the fuel injection valve 6. The booster 3 has a hydraulic piston 8, in which a large diameter piston 8*a* and a small diameter plunger 8*b* are coaxially provided. The hydraulic piston 8 is slidably installed in a large diameter bore and a small diameter bore, which are formed in a booster body 9 (refer to FIG. 5). In the large diameter bore, which installs the large diameter piston 8*a* therein, provides: a driving chamber 10 over an upper end face of the large diameter piston 8*a*; and a control chamber 11 below a lower end face of the large diameter piston 8*a*. In the small diameter bore, which installs the small diameter plunger 8*b* therein, provides a pressurizing chamber 12 below a lower end face of the small diameter plunger 8*b*.

The driving chamber 10 is connected via the fuel passage 13 to the fuel pipe 7, and supplied with the fuel pressure in the accumulator 2 via the fuel pipe 7 and the fuel passage 13. The fuel pressure in the driving chamber 10 acts on the upper end face of the hydraulic piston 8, to urge the hydraulic piston 8 downward.

The control chamber 11 is connected via a round passage constituting a part of the hydraulic circuit, which is described later, to a switching port 40 of the control valve 5 (the round passage and the switching port 40 are described later). The control valve 5 controls the fuel pressure in the control chamber 11. In the control chamber 11 is disposed a spring 14, as shown in FIG. 5, to urge the hydraulic piston 8 upward in the drawing.

The round passage is composed of two fuel passages 15, 16, which connect the switching port 40 of the control valve 5 in parallel with the control chamber 11 as shown in FIG. 1. One fuel passage 15 is provided with a check valve 17 that allows a fuel flow from the control valve 5 to the control chamber 11 and prevents a backward fuel flow. The other fuel passage 16 is provided with a hydraulic pressure valve 18, which is described below. The two fuel passages 15, 16 may be independent from each other over their entire length from one end connected to the switching port 40 of the control valve 5 to the other end connected to the control chamber 11. Alternatively, as shown in FIG. 1, the one end side portion and the other end side portion of the two fuel passages 15, 16 may be integrally formed.

The pressurizing chamber 12 is connected via a fuel passage 20 having a check valve 19 to the above-mentioned fuel pipe 7, and via a fuel passage 21 to a oil accumulator 4*a* provided in the nozzle 4 (refer to FIG. 5). The check valve 19 allows a fuel flow toward the pressurizing chamber 12 in the fuel passage 20, that is, a flow of the fuel supplied from the accumulator 2, and prevents a backward flow, that is, a fuel flow toward the accumulator 2. Thus, the fuel pressure in the accumulator 2 is transmitted to the pressurizing chamber 12, and via the fuel passage 21 to the oil accumulator 4*a* of the nozzle 4.

As shown in FIG. 5, the nozzle 4 is composed of: a nozzle body 23, at a leading end of which is formed an injection hole 22; a needle 24, which is installed in the nozzle body 23; a nozzle holder 26, which forms a back pressure chamber 25 over the needle 24 in the figure; and so on. The nozzle 4 is disposed below the booster body 9 and fastened by a retainer 27 to the booster body 9. In the nozzle body 23 is formed an annular fuel passage 28 to surround the needle 24, and the above-mentioned oil accumulator 4*a* at an upstream end of the fuel passage 28. Further, a conical sheet face (not shown) is formed between the fuel passage 28 and the injection hole 22.

The back pressure chamber 25 is connected via a fuel passage 29 constituting a part of the hydraulic circuit to the switching port 40 of the control valve 5, so that the control valve 5 controls the fuel pressure in the back pressure chamber 25. The fuel passage is provided with an aperture 30. When the fuel pressure in the accumulator 2 is transmitted to the back pressure chamber 25, the needle 24 receives the fuel pressure in the accumulator 2 and a restitutive force of a spring 31, which is installed in the back pressure chamber 25 (refer to FIG. 5), to be urged in a valve closing direction, that is, downward in FIG. 5. Thus, a sheet line (not shown), which is provided on a leading end portion of the needle 24, seats on the above-mentioned seat face, to block a communication between the fuel passage 28 and the injection hole 22. When the fuel pressure in the back pressure chamber 25 is released by the control valve 5, the needle 24 lifts up to allow the communication between the fuel passage 28 and the injection hole 22. Then, the fuel supplied to the oil accumulator 4*a* passes through the fuel passage 28 and is injected out of the injection hole 22.

As shown in FIG. 5, the control valve 5 has: a valve chamber 5*a*, which is formed in a control valve body 32; valve body 5*b*, which is installed in the valve chamber 5*a*; and a two-position actuator 33 for driving the valve body 5*b*. The control valve 5 is disposed on the booster body 9 and fastened by a retainer 34 to the booster body 9. As shown in FIG. 2, the valve chamber 5*a* is provided with: a input port 36, through which the fuel pressure in the accumulator 2 is supplied to the valve chamber 5*a* via a fuel passage 35 that is connected to the fuel pipe 7; a low pressure port 39, which is connected via a drain passage 37 to a fuel tank 38; a first switching port, which is connected via the above-mentioned round passage (the fuel passages 15, 16) to the control chamber 11 of the booster 3; and the second switching port, which is connected via the fuel passage 29 to the back pressure chamber 25 of the nozzle 4. The first and second switching ports are described as an switching port 40 in the following.

The valve body 5*b* switches between: a fuel pressure transmission mode (a position shown in FIGS. 1, 2 and 5) to interrupt a communication between the low pressure port 39 and the switching port 40 and to allow a communication between the input port 36 and the switching port 40; and a fuel pressure release mode (a position shown in FIGS. 3 and 4) to interrupt the communication between the input port 36 and the switching port 40 and to allow the communication between the low pressure port 39 and the switching port 40. That is, the control valve 5 is a two-position three way valve to switch a fuel flow direction in accordance with an operation mode.

As shown in FIG. 2, the two-position actuator 33 is composed of: a disk-shaped armature 41, which is connected to the valve body 5*b*; an electromagnetic coil 43, which is electrically controlled by an electric control unit (ECU) 42 mounted on the vehicle; a return spring 44 for urging the armature 41 downward in the drawing; and so on. When an electric power supply to the electromagnetic coil 43 is on, the two-position actuator 33 generates an electromagnetic force. The electromagnetic force draws the armature 41 upward in the figure against a restitutive force of the return spring 44, to generate a driving force. When the electric power supply to the electromagnetic coil 43 is stopped, the electromagnetic force disappears. In accordance with the electromagnetic force disappear, the restitutive force of the return spring 44 pushes the armature 41 back to an initial state shown in FIG. 2. The hydraulic circuit diagram of FIG. 2 shows an operational direction of the armature 41 in an opposite orientation from that in FIG. 5. That is, the energized the electromagnetic coil 43 generates the electromagnetic force to move the armature 41 downward in FIG. 5, and upward in FIG. 2.

As shown in FIG. 2, the above-mentioned hydraulic pressure valve 18 is composed of: a valve chamber 18*a*; the valve body 18*b*, which is installed in the valve chamber 18*a*; a spring 18*c* for urging the valve body 18*b*; and so on. The valve chamber 18*a* is provided with: an inlet port 45, which is communicated to the control chamber 11 of the booster 3; and an outlet port 46, which is communicated to the switching port 40 of the control valve 5. The valve body 18*b* switches between: a valve closing mode (a position shown in FIGS. 1, 2 and 5) to interrupt a communication between the inlet port 45 and the outlet port 46; and a valve opening mode (a position shown in FIG. 4) to allow the communication between the inlet port 45 and the outlet port 46. The spring 18*c* is installed in an operation chamber 18*d*, which is provided in a lower portion of the valve chamber 18*a* in a depressed manner, to urge the valve body 18*b* in a valve closing direction (upward in FIG. 2).

To the hydraulic pressure valve 18 is transmitted the fuel pressure in the accumulator 2 at all times via a branch passage 47, which is branched from the fuel passage 35. The fuel pressure in the hydraulic pressure valve 18 urges the valve body 18*b* in a valve opening direction (downward in FIG. 2). To the operation chamber 18*d* is transmitted a fuel pressure at a magnitude in accordance with an operation mode of the control valve 5 via a pressure transmission path 48, which is connected to the switching port 40 of the control valve 5. That is, when the control valve 5 is set to the fuel pressure transmission mode, the fuel pressure in the accumulator 2 is transmitted via the pressure transmission path 48 to the operation chamber 18*d*. Then, a difference between a force to urge the valve body 18*b* in the valve opening direction and a force to urge the valve body 18*b* in the valve closing direction decreases or is equalized. In this manner, the restitutive force of the spring 18*c* urges the valve body 18*b* in the valve closing direction, to set the control valve 5 to the valve closing mode.

When the control valve 5 is set to the fuel pressure release mode, the operation chamber 18*d* is communicated with a low pressure side, and a pressure difference acting on the valve body 18*b* increases (the force to urge the valve body 18*b* in the valve opening direction becomes larger than the force to urge the valve body 18*b* in the valve closing direction). Then, the valve body 18*b* is urged in the valve opening direction against the restitutive force of the spring 18*c*, to be set to the valve opening mode. That is, the hydraulic pressure valve 18 is a two-position two way valve to open and close the fuel passage 16 in accordance with an operation mode.

In the first embodiment, the pressure transmission path 48 is provided with an aperture 49 as shown in FIG. 1. Thus, when the control valve 5 is switched from the fuel pressure transmission mode to the fuel pressure release mode, the aperture 49 generates a specific length of time lag in switching the hydraulic pressure valve 18 from the valve closing mode to the valve opening mode. The aperture 49 is configured to generate the specific length of the time lag.

Figure 6:
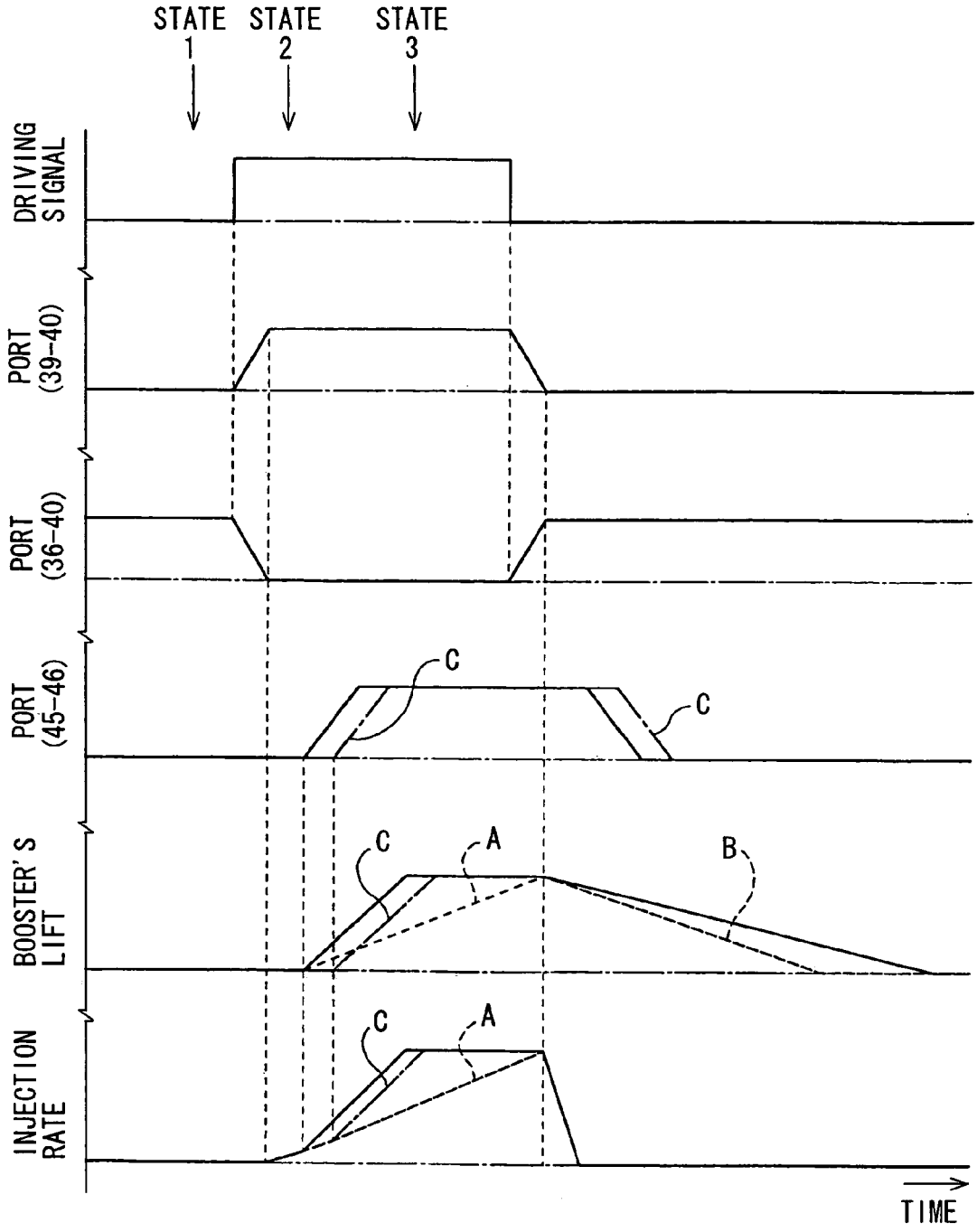
FIG. 6 is a timing chart showing an operation of the fuel injection apparatus according to the first embodiment.

An operation of the fuel injection apparatus is described in the following referring to FIGS. 2 to 4 and a timing chart shown in FIG. 6. States 1, 2 and 3 in FIG. 6 respectively correspond to the states shown in FIGS. 2, 3 and 4. When the electromagnetic coil 43 of the two-position actuator 33 is OFF, as shown in FIG. 2, the control valve 5 is set to the fuel pressure transmission mode. The fuel pressure transmission mode blocks the communication between the switching port 40 and the low pressure port 39, and allows the communication between the input port 36 and the switching port 40. Thus, the fuel pressure in the accumulator 2 is transmitted to the switching port 40. The fuel pressure in the accumulator is transmitted via the pressure transmission path 48 to the operation chamber 18*d*, so that the hydraulic pressure valve 18 is set to the valve closing mode.

Accordingly, the fuel pressure in the accumulator 2 is transmitted via the one fuel passage 15 to the control chamber 11 of the booster 3, and also via the fuel passage 29 to the back pressure chamber 25 of the nozzle 4. In the booster 3 in this time, the fuel pressure in the accumulator 2 is also transmitted to the driving chamber 10 and to the pressurizing chamber 12, to balance the fuel pressure acting on both of an upper and lower end faces of the hydraulic piston 8 with each other. As a result, the spring 14 (refer to FIG. 5) urges the hydraulic piston 8 upward in the figure. Thus, a volume of the pressurizing chamber 12 gradually increases, to fill the fuel in the pressurizing chamber 12 in accordance with the volume increase of the pressurizing chamber 12. In this state, the fuel pressure in the back pressure chamber 25 of the nozzle 4 is equal to that in the accumulator 2, so that the needle 24 does not lift up. Thus, the communication between the fuel passage 28 and the injection hole 22 in the nozzle 4 is kept blocked, and no fuel is injected.

Next, the ECU 42 outputs a driving signal to the two-position actuator 33 to energize the electromagnetic coil 43. Then, as shown in FIG. 3, the control valve 5 is switched from the fuel pressure transmission mode to the fuel pressure release mode. The fuel pressure release mode blocks the communication between the input port 36 and the switching port 40, and allows the communication between the switching port 40 and the low pressure port 39. Thus, the back pressure chamber 25 of the nozzle 4 is communicated with the low pressure side, to release the fuel pressure in the back pressure chamber 25. Then, the needle 24 lifts up, and the fuel supplied to the oil accumulator 4*a* is injected out of the injection hole 22. In this time, the hydraulic pressure valve 18 is kept to the valve closing mode shown in FIG. 3 until the fuel pressure in the back pressure chamber 25 decreases to a specific pressure, so that the hydraulic piston 8 does not concurrently move with the fuel pressure release in the back pressure chamber 25. Accordingly, an injection pressure of the nozzle 4 is not equal to a super high pressure, which is increased by the booster 3, but approximately equal to the fuel pressure in the accumulator 2.

Then, the fuel pressure in the back pressure chamber 25 decreases to the specific pressure. Further, the hydraulic pressure valve 18 is switched from the valve closing mode to the valve opening mode in the specific length of the time lag configured by the aperture 49 of the pressure transmission path 48 as shown in FIG. 4. Thus, the control chamber 11 of the booster 3 is connected via the hydraulic pressure valve 18 to the switching port 40 of the control valve 5, to release the fuel pressure in the control chamber 11 to the lower pressure side. As a result, the fuel pressure acting on both of an upper and lower end faces of the hydraulic piston 8 get out of balance with each other. Accordingly, the fuel pressure in the driving chamber 10 urges the hydraulic piston 8 downward.

In accordance with the movement of the hydraulic piston 8, the fuel pressure in the pressurizing chamber 12 start increasing. Ultimately, the fuel pressure in the pressurizing chamber 12 is increased in accordance with a cross-sectional area ration of the large diameter piston 8*a* to the small diameter plunger 8*b*. For example, when the fuel pressure in the accumulator 2 is set to 50 MPa, and a cross-sectional area ratio of the large diameter piston 8*a* to the small diameter plunger 8*b* is set to 4:1, the fuel pressure in the pressurizing chamber 12 will be (4×50=) 200 MPa. Accordingly, the super high pressure, the pressure of which is increased by the booster 3, is injected out of the nozzle 4.

Subsequently, when the electric power supply to the electromagnetic coil 43 is stopped at a specific timing (when an injection amount reaches a specific value, for example), the control valve 5 is switched from the fuel pressure release mode to the fuel pressure transmission mode. Thus, the fuel pressure in the accumulator 2 is transmitted to the back pressure chamber 25 of the nozzle 4 and to the control chamber 11 of the booster 3. Accordingly, in the nozzle 4, the fuel pressure in the back pressure chamber 25 increases, to push the needle 24 back to stop the injection. In the booster 3, the fuel pressure in the control chamber 11 increases, so that the hydraulic piston 8 immediately stops a pressure increasing operation and starts a return process.

Figure 7:
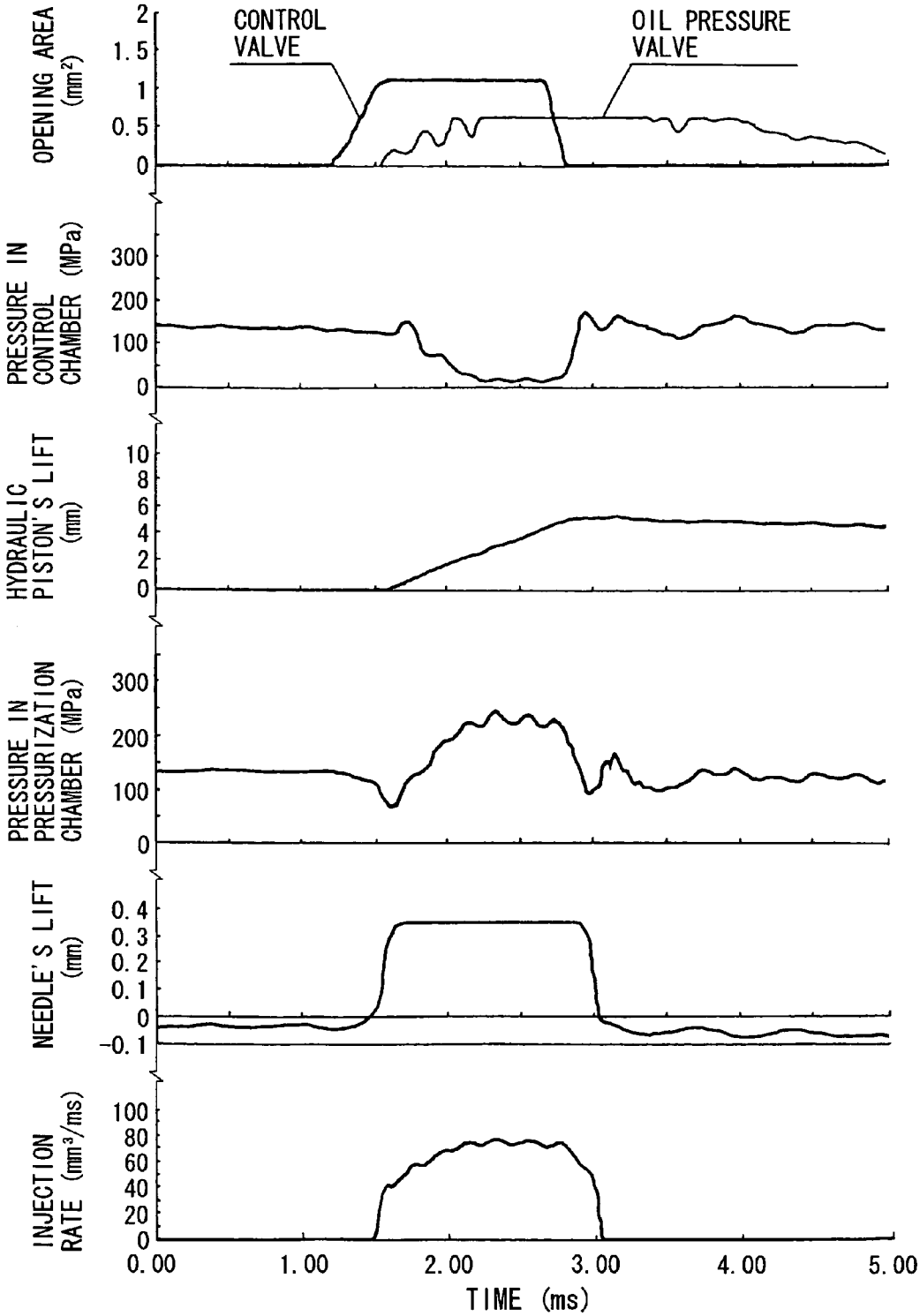
FIG. 7 is a graph showing an operation of the fuel injection apparatus according to the first embodiment, which is calculated by a computer simulation.

FIG. 7 depicts an operation of the fuel injection apparatus 1 according to the first embodiment, which is calculated by a computer simulation. In the simulation, the cross-sectional area ratio is set to 2:1. The simulation supports the above-described operations and performances of the fuel injection apparatus 1.

The fuel injection apparatus 1 according to the first embodiment is provided with the two fuel passages 15, 16 that connect the switching port 40 of the control valve 5 in parallel with the control chamber 11. Thus, a different path is used in a case to release the fuel pressure in the control chamber 11 from a case to increase the fuel pressure. That is, in increasing the fuel pressure in the control chamber 11, the fuel pressure in the accumulator 2 is transmitted to the control chamber 11 via the one fuel passage 15 provided with the check valve 17. In releasing the fuel pressure in the control chamber 11, the fuel pressure is released to a lower pressure side via the other fuel passage 16 provided with the hydraulic pressure valve 18.

According to the above-described construction, the fuel pressure in the control chamber 11 slowly decreases slower by providing the other fuel passage 16 with an aperture (not shown). Thus, as represented by a broken line A in FIG. 6, it is possible to modify a pressure increase speed of the booster 3 (a moving speed of the hydraulic piston 8). Alternatively, the fuel pressure in the control chamber 11 slowly decreases by providing the one fuel passage 15 with an aperture (not shown). Thus, as represented by a broken line B in FIG. 6, it is possible to modify the pressure decrease speed of the booster 3 (the moving speed of the hydraulic piston 8).

Further, in the first embodiment, the pressure transmission path 48, which is connected to the operation chamber 18*d* of the hydraulic pressure valve 18, is provided with the aperture 49. Thus, it is possible to delay a timing for the hydraulic pressure valve 18 to be switched from the valve closing mode to the valve opening mode. Accordingly, as represented by a broken line C in FIG. 6, it is possible to apply a time lag to a timing to start operating the booster 3 (to start the pressure increase). In this manner, it is possible to optimize an injection ratio patterns in accordance with a driving condition of the internal combustion engine, by modifying the pressure increasing speed of the booster 3, the pressure decreasing speed of the booster 3, and the starting timing of the pressure increase of the booster 3. As commonly known, the optimization of the injection patterns is effective for exhaust gas cleaning and output power increase. In addition, by modifying the pressure decreasing speed of the booster 3, it is possible to perform such settings as to initialize the injection ratio regardless of other properties, especially in a high-speed internal combustion engine.

Furthermore, by delaying the pressure increase starting timing, it is possible to set an initial injection pressure to a small value and to modify the duration time of the initial injection by the aperture 49. Specifically, in a micro injection, which does not require a super high fuel pressure, a time to the injection state is quite small, so that it is possible to inject the fuel at a non-increased pressure (at the fuel pressure in the accumulator 2).

In the fuel injection apparatus 1 according to the first embodiment, a fuel leakage does not occur except a switching leakage, which slightly occurs in switching the operation modes of the control valve 5, so that it is possible to limit an energy loss, and to improve a fuel consumption performance of the internal combustion engine. Further, the two fuel passages 15, 16 connect the control valve 5 in parallel with the control chamber 11 of the booster 3, so that the pressure increase step finishes at the same time as the injection finishes. Thus, it is possible to decrease a wasteful operation of the booster 3, not to waste a driving energy.

Modification of the First Embodiment

In the first embodiment, the pressure transmission path 48 is provided with the aperture 49, to delay the timing for the hydraulic pressure valve 18 to be switched from the valve closing mode to the valve opening mode. Thus, a time lag is applied to the operation start of the booster 3 (to the pressure increase start timing). Alternatively, instead of the aperture 49, it is possible to adjust the time lag by adequately setting an operation pressure of the hydraulic pressure valve 18. For example, the time lag can be modified also by adjusting a load of the spring 18*c* to urge the valve body 18*b* of the hydraulic pressure valve 18. The time lag to operate the hydraulic pressure valve 18 can be delayed also by a cooperative operation of an effect of the aperture 49 provided in the pressure transmission path 48 and an operation pressure of the hydraulic pressure valve 18.

Second Embodiment

Figure 8:
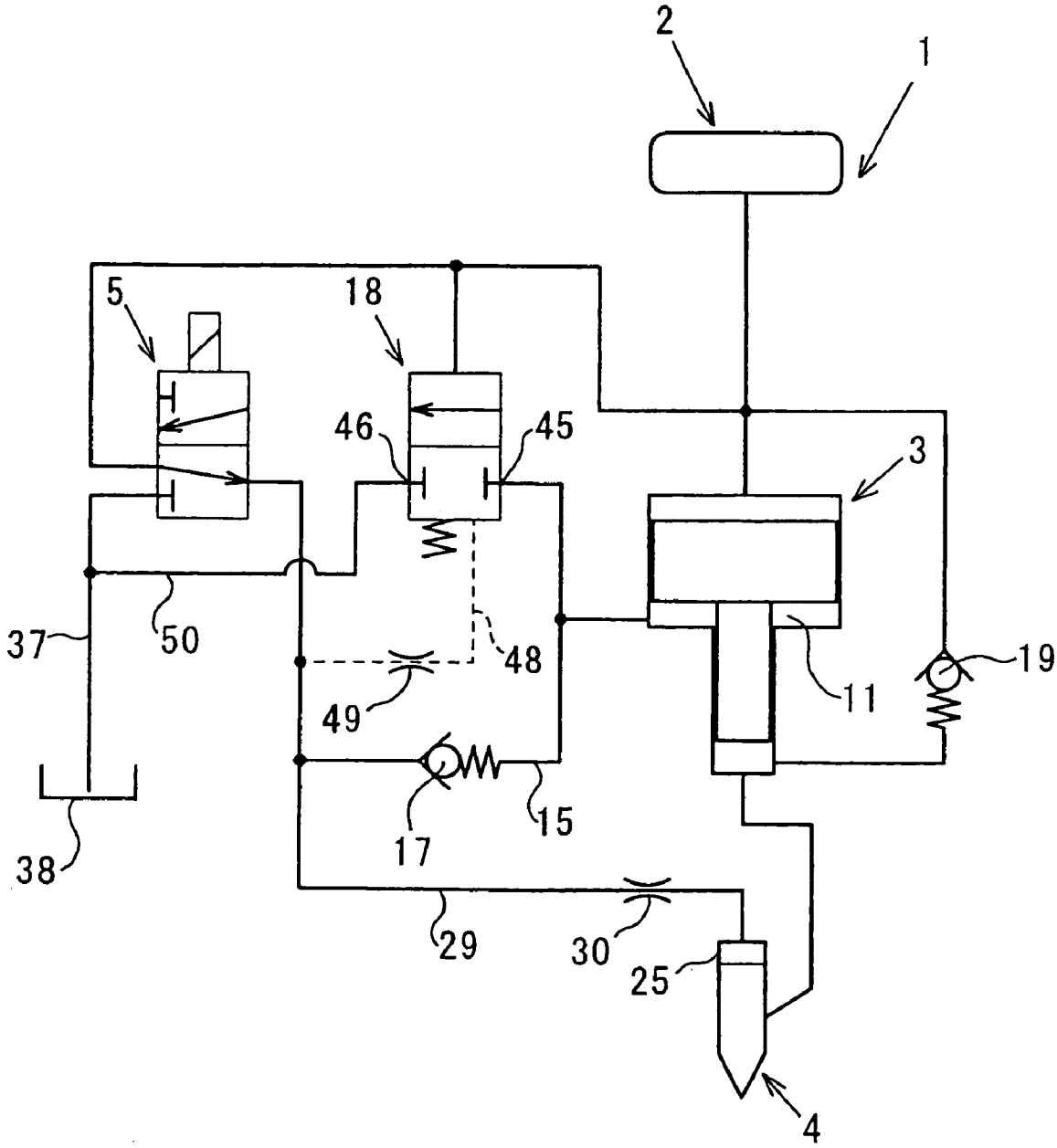
FIG. 8 is a hydraulic circuit diagram of a fuel injection apparatus according to a second embodiment of the present invention.

FIG. 8 depicts a hydraulic circuit of the fuel injection apparatus 1 according to a second embodiment of the present invention.

The fuel injection apparatus 1 according to the second embodiment differs from the first embodiment in a construction of passages to connect the hydraulic pressure valve 18 to the outlet port 46. That is, in the first embodiment, the outlet port 46 of the hydraulic pressure valve 18 is connected to the switching port 40 of the control valve 5. In the second embodiment, as shown in FIG. 8, the outlet port 46 of the hydraulic pressure valve 18 is connected via an outlet passage 50 (a part of the second fuel passage) to the drain passage 37. Thus, when in discharging a relatively large amount of the fuel out of the control chamber 11 of the booster 3 in a short time, the fuel do not pass through the control valve 5. Thus, it is possible to downsize the control valve 5.

The pressure transmission path 48, which is connected to the operation chamber 18*d* of the hydraulic pressure valve 18 (refer to FIG. 2), is provided with the aperture 49. By an effect of the aperture 49 and/or an operation pressure of the hydraulic pressure valve 18, it is possible to apply a time lag to a timing to start operating the booster 3 (to start the pressure increase), in the same manner as in the first embodiment.

Third Embodiment

Figure 9:
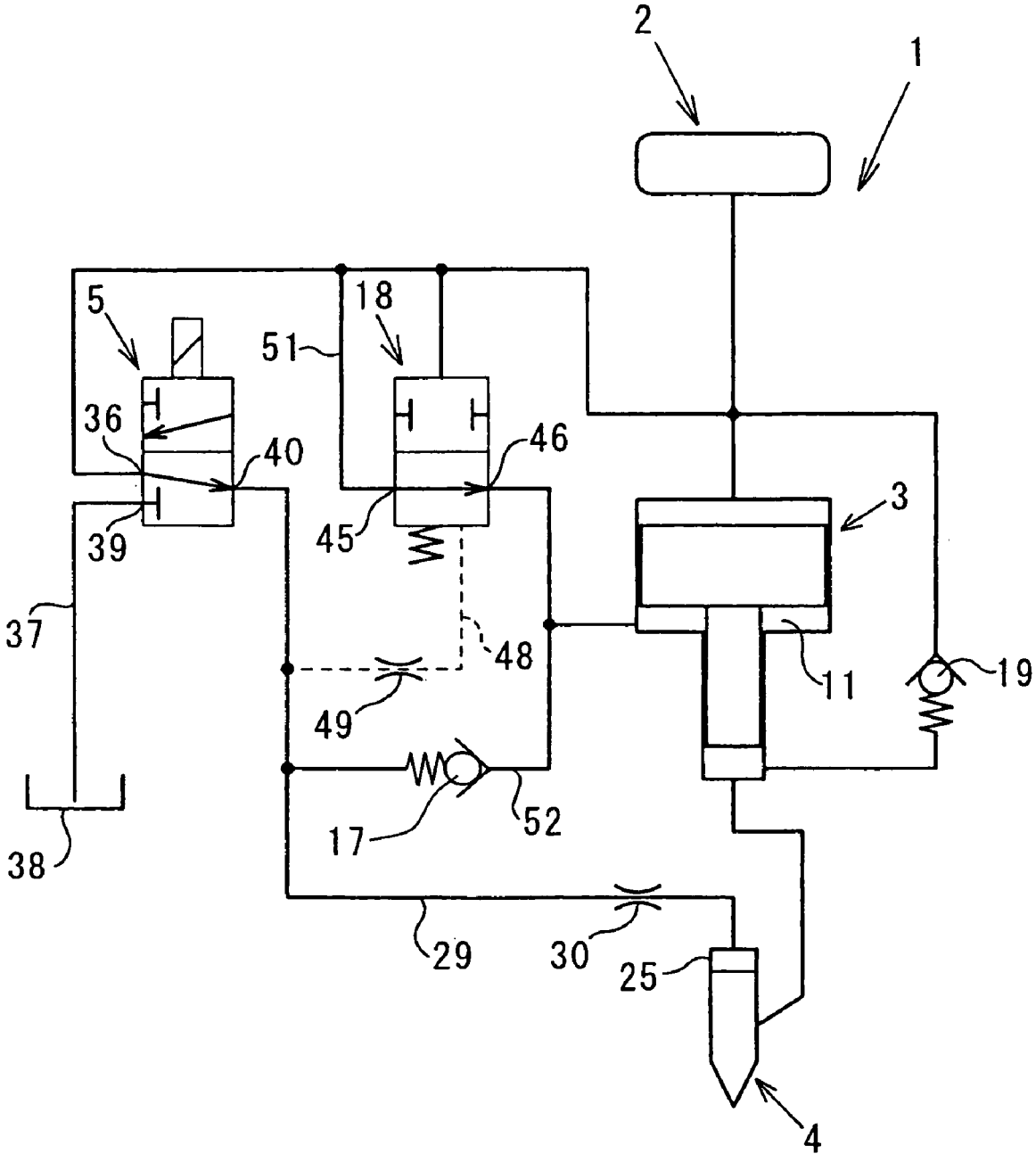
FIG. 9 is a hydraulic circuit diagram of a fuel injection apparatus according to a third embodiment of the present invention.

FIG. 9 depicts a hydraulic circuit of a fuel injection apparatus 1 according to a third embodiment of the present invention.

The fuel injection apparatus 1 according to the third embodiment is an example in which an inflow passage 51 (a second fuel passage), which is connected to the control chamber 11 of the booster 3 is provided with a hydraulic pressure valve 18, and an outflow passage 52 (a first fuel passage) is provided with a check valve 17. The inflow passage 51 is a fuel passage for transmitting the fuel pressure in the accumulator 2 to the control chamber 11. As shown in FIG. 9, the inlet port 45 of the hydraulic pressure valve 18 is connected to the accumulator 2, and the outlet port 46 is connected to the control chamber 11. The outflow passage 52 is a fuel passage for releasing the fuel pressure in the control chamber 11 to the lower pressure side. As shown in FIG. 9, the outflow passage 52 connects the control chamber 11 to the switching port 40 of the control valve 5.

The hydraulic pressure valve 18, which is provided in the inflow passage 51, is in the valve opening mode (a state shown in FIG. 9) to open the inflow passage 51 when the control valve 5 is in the fuel pressure transmission mode. The hydraulic pressure valve 18 is in the valve closing mode to block the inflow passage 51 when the control valve 5 is in the fuel pressure release mode. The check valve 17, which is provided in the outflow passage 52, allows a fuel flow from the control chamber 11 to the control valve 5, and prevents a backward fuel flow. Thus, when the control valve 5 is set to the fuel pressure transmission mode, the fuel pressure in the accumulator 2 is transmitted via the inflow passage 51 to the control chamber 11. When the control valve 5 is switched to the fuel pressure release mode, the fuel pressure in the control chamber 11 is released via the outflow passage 52 to the lower pressure side, to start the pressure increase operation of the booster 3.

In the third embodiment, the pressure transmission path 48, which is connected to the operation chamber 18*d* of the hydraulic pressure valve 18 (refer to FIG. 2), is provided with the aperture 49. By an effect of the aperture 49 and/or an operation pressure of the hydraulic pressure valve 18, it is possible to apply a time lag to a timing to start operating the booster 3 (to start the pressure increase), in the same manner as in the first embodiment.

In the third embodiment, it is possible to improve a flexibility in the pressure decreasing step including a pressure increase completion timing. It is also possible to equalize the injection start timing and pressure increase start timing approximately with each other. Thus, it is possible to start pressure increase from an initial time, to derive a triangular shaped injection ratio pattern in a wave form of the injection ratio.

Fourth Embodiment

Figure 10:
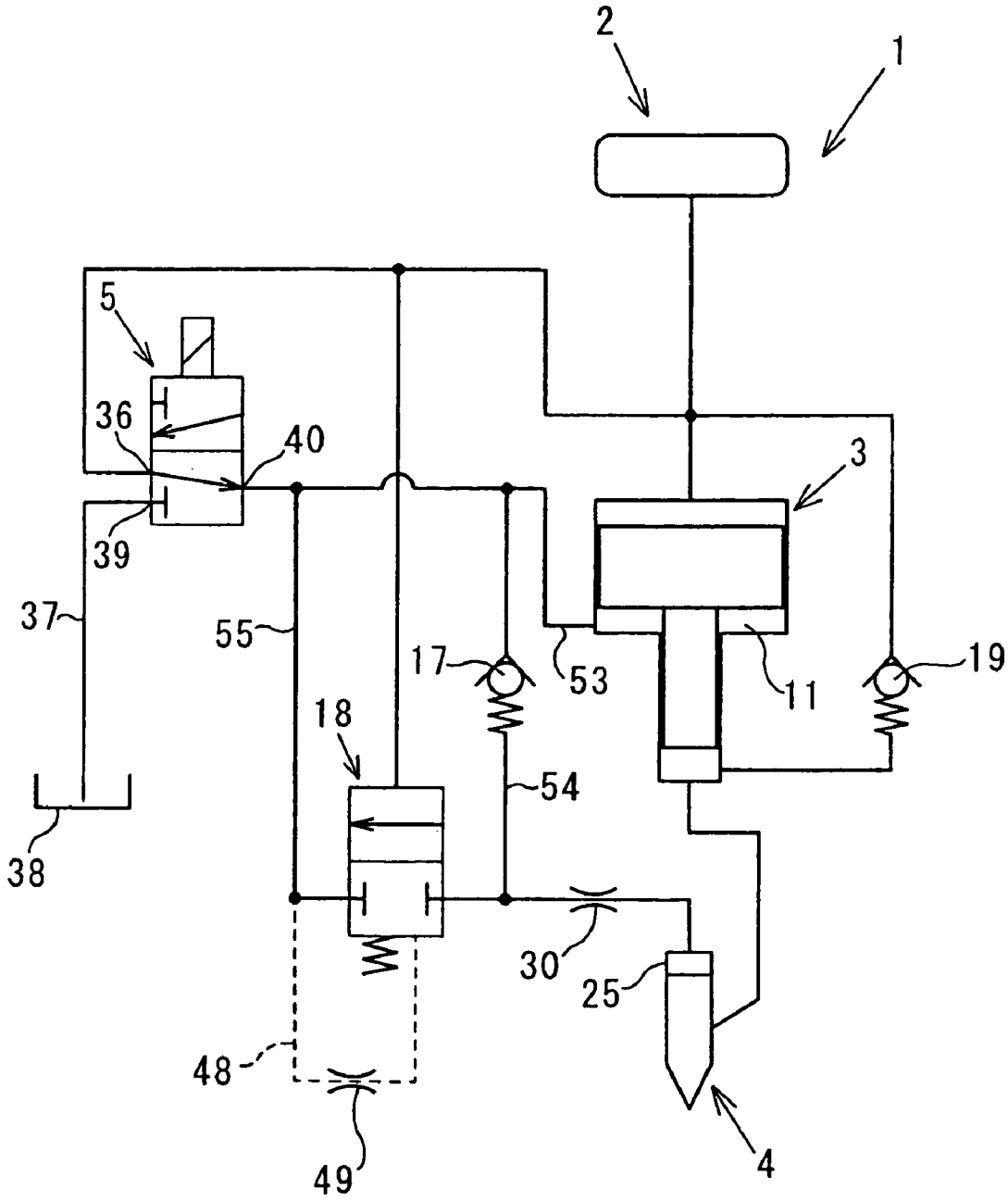
FIG. 10 is a hydraulic circuit diagram of a fuel injection apparatus according to a fourth embodiment of the present invention.
Figure 11:
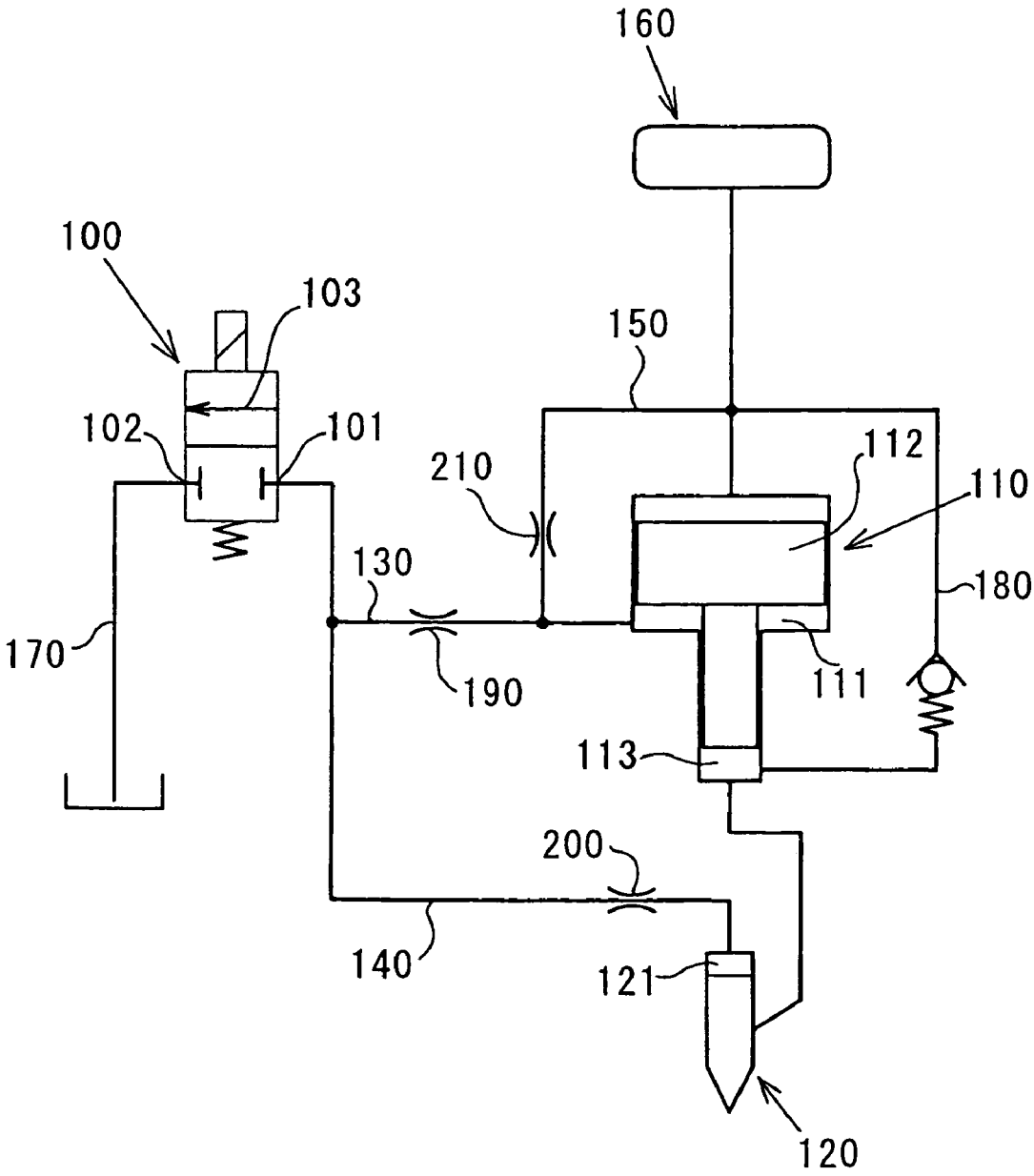
FIG. 11 PRIOR ART
FIG. 11 is a hydraulic circuit diagram of a conventional fuel injection apparatus.

FIG. 10 depicts a hydraulic circuit of a fuel injection apparatus 1 according to a fourth embodiment of the present invention.

In the fuel injection apparatus 1 according to the fourth embodiment, the control chamber 11 of the booster 3 is directly connected via one fuel passage 53 to the switching port 40 of the control valve 5. The switching port 40 of the control valve 5 is connected by two fuel passages 54, 55 in parallel to the back pressure chamber 25 of the nozzle 4.

The fuel passage 54 (a first fuel passage) is provided with the check valve 17, which allows a fuel from the control valve 5 to the back pressure chamber 25, and prevents a backward fuel flow. The fuel passage 55 (a second fuel passage) is provided with the hydraulic pressure valve 18. The hydraulic pressure valve 18 is in the valve closing mode (a state shown in FIG. 10) to block the fuel passage 55 when the control valve 5 is in the fuel pressure transmission mode. The hydraulic pressure valve 18 is in the valve opening mode to open the fuel passage 55 when the control valve 5 is in the fuel pressure release mode.

In the fourth embodiment, the pressure transmission path 48, which is connected to the operation chamber 18*d* of the hydraulic pressure valve 18 (refer to FIG. 2), is provided with the aperture 49. By an effect of the aperture 49 and/or an operation pressure of the hydraulic pressure valve 18, it is possible to apply a time lag to a timing to start operating the booster 3 (to start the pressure increase), in the same manner as in the first embodiment.

By the construction according to the fourth embodiment, when the control valve 5 is switched from the fuel pressure transmission mode to the fuel pressure release mode, the fuel pressure in the control chamber 11 of the booster 3 immediately starts decreasing to start pressure increase in the booster 3. Then, the hydraulic pressure valve 18 starts operating (is switched from the valve closing mode to the valve opening mode) with a time lag, and the fuel pressure in the back pressure chamber 25 decreases to start fuel injection. Thus, it is possible to inject the fuel at the super high pressure from an injection start, to derive a pulse shaped injection ratio pattern.

When the fuel injection completes, the control valve 5 is switched to the fuel pressure transmission mode, so that the pressure increasing operation of the booster 3 immediately stops. Concurrently, a high pressure, that is, the fuel pressure in the accumulator 2 is transmitted via the one fuel passage 54 having the check valve 17 to the back pressure chamber 25, so that the fuel injection rapidly stops. This effect is achieved not by the hydraulic pressure valve 18, which starts operating with a time lag. The rapid fuel injection stop is effective for decreasing a black smoke emitted from the internal combustion engine.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection apparatus for an internal combustion engine comprising:

an accumulator for accumulating fuel therein at a predetermined pressure;

a booster provided with a control chamber in which fuel pressure changes in accordance with a fuel inflow into the control chamber and a fuel outflow out of the control chamber, and a hydraulic piston that moves in accordance with a change of the fuel pressure in the control chamber, the booster pressurizing the fuel supplied from the accumulator in accordance with a pressurizing operation of the hydraulic piston;

a nozzle provided with a back pressure chamber in which fuel pressure changes in accordance with a fuel inflow into the back pressure chamber and a fuel outflow out of the back pressure chamber, and a needle that moves in accordance with a change of the fuel pressure in the back pressure chamber, the nozzle injecting the fuel supplied from the accumulator or the fuel pressurized by the booster in accordance with a valve opening operation of the needle;

a hydraulic circuit provided with a fuel passage for transmitting the fuel pressure in the accumulator to the control chamber and to the back pressure chamber, and a fuel passage for releasing the fuel pressure in the control chamber and in the back pressure chamber to a low pressure system;

a hydraulic pressure valve provided with a valve body that is disposed in a fuel passage communicated with the control chamber or disposed in a fuel passage communicated with the back pressure chamber to open and block the fuel passage to control an operation of the valve body in accordance with the fuel pressure that is transmitted via a transmission path connected to the hydraulic circuit; and a control valve provided with a valve body that is driven by a two-position actuator, the valve body connecting any one of a high pressure side communicated the accumulator and the low pressure system communicated with a fuel tank to the hydraulic circuit, to control the hydraulic circuit, and to control the fuel pressure transmitted to the hydraulic pressure valve, one of the fuel pressure in the control chamber and the fuel pressure in the back pressure chamber being directly controlled by the control valve, and the other of the fuel pressure in the control chamber and the fuel pressure in the back pressure chamber being indirectly controlled via the hydraulic pressure valve, to control an operation of the booster and an operation of the nozzle, wherein at least one of the transmission path and the hydraulic piston is configured to generate a delay in an operation of the nozzle or the booster that is driven by the other of the fuel pressure in the back pressure chamber and the fuel pressure in the control chamber indirectly controlled by the hydraulic pressure valve, against an operation of the booster or the nozzle that is driven by the one of the fuel pressure in the control chamber and the fuel pressure in the back pressure chamber directly controlled by the control valve.

2. The fuel injection apparatus for an internal combustion engine according to claim 1, wherein the transmission path is provided with an aperture to generate the delay.

3. The fuel injection apparatus for an internal combustion engine according to claim 1, wherein an operation pressure of the hydraulic piston is set to a value to generate the delay.

4. The fuel injection apparatus for an internal combustion engine according to claim 1, wherein the transmission path is provided with an aperture and an operation pressure of the hydraulic piston is set to a value to generate the delay.

5. The fuel injection apparatus for an internal combustion engine according to claim 1, wherein the control valve is provided with:

a switching port connected to the hydraulic circuit;

an input port communicated with the accumulator; and a low pressure port connected to a drain passage at a side of the low pressure system, and the valve body of the control valve is a two-position three way valve that selectively switches between a fuel pressure transmission mode in which the valve body blocks a communication between the low pressure port and the switching port and allows a communication between the input port and the switching port, and a fuel pressure release mode in which the valve body blocks the communication between the input port and the switching port and allows the communication between the low pressure port and the switching port.

6. The fuel injection apparatus for an internal combustion engine according to claim 1, wherein the hydraulic pressure valve is a two-position two way valve.

7. The fuel injection apparatus for an internal combustion engine according to claim 1, further comprising two fuel passages connecting the control valve in parallel with the control chamber, one of the fuel passages being provided with a fuel flow direction restriction means that allows a fuel flow from the control valve to the control chamber and prevents a fuel flow from the control chamber to the control valve, and the other of the fuel passages being provided with the hydraulic pressure valve.

8. The fuel injection apparatus for an internal combustion engine according to claim 1, further comprising:

a first fuel passage that connects the control chamber to the control valve and is provided with a fuel flow direction restriction means that allows a fuel flow from the control valve to the control chamber and prevents a fuel flow from the control chamber to the control valve; and a second fuel passage that connects the control chamber to a drain passage at a side of the low pressure system and is provided with the hydraulic pressure valve.

9. The fuel injection apparatus for an internal combustion engine according to claim 1, further comprising:

a first fuel passage that connects the control chamber to the control valve and is provided with a fuel flow direction restriction means that allows a fuel flow from the control chamber to the control valve and prevents a fuel flow from the control valve to the control chamber; and a second fuel passage that connects the control chamber to the accumulator and is provided with the hydraulic pressure valve.

10. The fuel injection apparatus for an internal combustion engine according to claim 1, further comprising two fuel passages connecting the control valve in parallel with the back pressure chamber, one of the fuel passages being provided with a fuel flow direction restriction means that allows a fuel flow from the control valve to the back pressure chamber and prevents a fuel flow from the back pressure chamber to the control valve, and the other of the fuel passages being provided with the hydraulic pressure valve.

11. The fuel injection apparatus for an internal combustion engine according to claim 1, wherein the hydraulic pressure valve is operated by a pressure difference between the fuel pressure transmitted from the transmission path and the fuel pressure in the accumulator.

12. The fuel injection apparatus for an internal combustion engine according to claim 1, wherein the fuel passage communicated with the back pressure chamber is provided with an aperture, an opening degree of the aperture variably determining a moving speed of the needle.

13. The fuel injection apparatus for an internal combustion engine according to claim 1, wherein the fuel passage communicated with the control chamber is provided with an aperture, an opening degree of the aperture variably determining a moving speed of the hydraulic piston.

14. The fuel injection apparatus for an internal combustion engine according to claim 1, wherein the fuel passage communicated with the back pressure chamber and the fuel passage communicated with the control chamber are respectively provided with apertures, opening degrees of the apertures variably determining a moving speed of the needle and a moving speed of the hydraulic piston.

* * * * *